United States Patent [19]

Windall

[11] 4,139,197

[45] Feb. 13, 1979

[54] PRACTICE DEVICE FOR HITTING A BALL

[76] Inventor: Owen D. Windall, 877 Westfield Rd., Scotch Plains, N.J. 07076

[21] Appl. No.: 867,587

[22] Filed: Jan. 6, 1978

[51] Int. Cl.[2] ..... A63B 69/36

[52] U.S. Cl. ..... 273/185 C; 273/200 A; 273/DIG. 21

[58] Field of Search ..... 273/184 R, 184 B, 185 B, 273/185 C, 200 R, 200 A, 198, DIG. 21

[56] References Cited

U.S. PATENT DOCUMENTS

| | | | |
|---|---|---|---|
| 2,032,081 | 2/1936 | Deane et al. | 273/185 C |
| 2,230,282 | 2/1941 | Bickerton | 273/185 C |
| 3,324,726 | 6/1967 | Turczynski | 273/184 B X |
| 3,340,735 | 9/1967 | Kastrans | 273/184 B |
| 3,430,493 | 3/1969 | Wall | 273/185 C |
| 3,494,621 | 2/1970 | Windall | 273/200 R |

*Primary Examiner*—George J. Marlo

*Attorney, Agent, or Firm*—Lerner, David, Littenberg & Samuel

[57] ABSTRACT

A practice device for hitting a ball is provided which includes a housing and a device for attaching the housing in a relatively fixed position, and a line connector and a suitable device for attaching the connector in a relatively fixed position spaced from the housing. A line guide is also provided which extends between the housing and the connector for guiding the movement of a tethered ball when it is struck. A suitable line or cord connects the tethered ball to a movable indicator arm mounted on the housing for indicating the equivalent distance that the tethered ball is hit. In addition, the practice device is also provided with a device for indicating the height that the tethered ball is hit, as well as a left-right indicator for indicating the left-right angle at which the tethered ball is hit. In a preferred embodiment, a cord storage device, which includes a reel, is provided for winding up and storing cord.

18 Claims, 6 Drawing Figures

PRACTICE DEVICE FOR HITTING A BALL

FIELD OF THE INVENTION

The present invention relates generally to practice devices which is extremely simple in construction and economical to manufacture and provides all of the information necessary for a user to improve the hitting of a ball, including indications as to distance, height, and angle of each hit ball so that the user can easily evaluate each hit ball and make any necessary changes to quickly improve his performance.

BACKGROUND OF THE INVENTION

In recent years, many different types of ball-hitting devices have been developed and constructed. Many of such devices have been in the field of golf, and their objective has been to allow the user to assess the quality of each stroke or shot so that he can improve his performance. Although prior art devices provide to some extent information which the user can evaluate to improve his hitting performance, they generally have a number of drawbacks. For example, some of the prior art apparatus is complex in structure and is relatively expensive to manufacture, which makes these devices somewhat unpractical. In addition, although such apparatus purports to provide indications as to distance and angle of a particular shot, because of their constructions, such devices have been found to be somewhat inaccurate. For example, in some of the prior art golf practice devices, if a shot is hit high, the device merely takes into account the force with which the shot is hit and converts this to a distance indication which is the same for high and low-hit shots. As a result, inaccurate distance indications are provided, particularly for high-hit balls.

Moreover, such prior art ball-hitting devices, including golf practice devices, do not provide complete information about each shot. For example, in order to make an accurate evaluation, the user must be provided with information as to the distance of the shot, the angle at which it is hit, and the height of the shot. Once the user has accurate information with respect to each of these variables, he will then be in a position to accurately evaluate each of his shots in order to make necessary adjustments to improve his performance.

Accordingly, it is an object of the present invention to provide an improved practice device which overcomes the aforesaid problems. Specifically, it is within the contemplation of the present invention to provide an improved practice device for hitting balls which provides complete and accurate information with respect to each shot, including indications as to distance, left-right angle, and the height of each shot. In this manner, the user is able to easily evaluate such information to improve his performance.

SUMMARY OF THE INVENTION

Briefly, in accordance with the principles of the present invention, an improved practice device for hitting a ball is provided and includes a housing and a device for attaching the housing in a relatively fixed position, as well as a line connector and a device for attaching the connector in a relatively fixed position but spaced from the housing. A line guide extends between the housing and the connector, and the tethered ball to be hit movably slides on the line guide. A suitable line or cord is connected to the tethered ball and operates to actuate a movable indicator arm when the tethered ball is hit and is mounted on the housing for indicating the equivalent distance that the tethered ball is hit.

In addition, in the preferred embodiment, the housing includes a device for indicating the height that the tethered ball is hit, as well as including a device for indicating the left-right angle that the tethered ball is hit. In addition, the line connector may include a reel for winding up and storing the cord or line in a convenient manner.

Advantageously, as a result of the present invention, a simple and economical device is provided which gives the user complete and accurate information with respect to each shot, including indications as to distance, left-right angle, and height of the shot, so that the user may easily evaluate this information to quickly improve his performance.

BRIEF DESCRIPTION OF THE DRAWINGS

Further objects, features, and advantages of the present invention will become apparent upon the consideration of the following detailed description of presently-preferred embodiments, when taken in conjunction with the accompanying drawings, wherein.

DETAILED DISCUSSION OF PREFERRED EMBODIMENTS OF THE INVENTION

Figure 1:
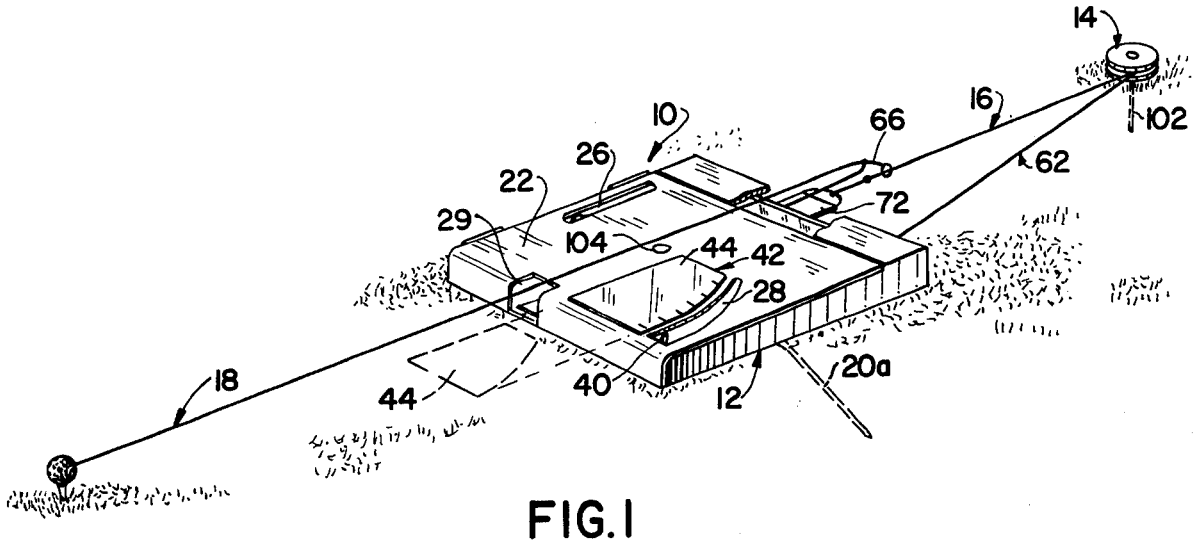
FIG. 1 is a perspective view of a golf practice device embodying the principles of the present invention.

Referring now to FIG. 1, there is shown a practice device for hitting balls embodying the principles of the present invention, generally designated by the reference numeral 10, which includes as its major components, a housing 12, a cord storage device 14, a line guide 16 extending between housing 12 and cord storage device 14, and a tethered ball 18 mounted for sliding movement along line guide 16 when the tethered ball 18 is hit.

Figure 2:
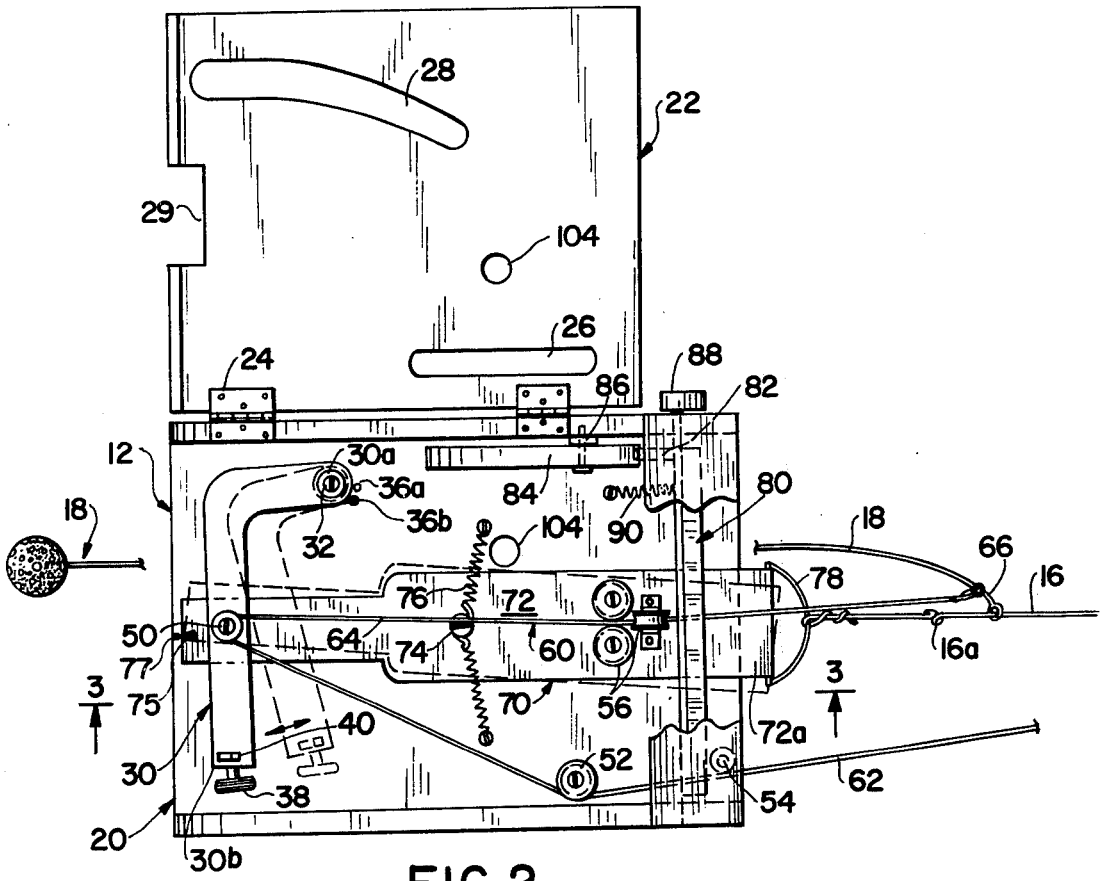
FIG. 2 is a plan view of the device shown in FIG. 1, with the cover of the housing in its open position to illustrate in detail the elements contained therein.

Referring now to FIG. 2, housing 12 is illustrated in detail. More particularly, housing 12 includes a base or frame 20 which is provided with a cover 22 attached by hinges 24 to the base 20. Cover 22 includes a first cutout portion 26, a second cutout portion 28, and a third cutout portion 29 through which indicators are visible, in a manner to be explained, to provide the user with information with regard to each shot.

Mounted on the base 20 is a movable indicator arm 30 having a substantially L-shaped configuration and which is pivotally mounted at one end **30*a* thereof on base 20. Indicator arm 30 is pivotally mounted at 30*a* by any suitable means, such as a screw or pivot device 32. In addition, pivot 32 is surrounded with a leaf spring 34 which operates to bias indicator arm 30 from its dotted-line position to its solid-line position. In addition, base 20 is provided with suitable holes 36*a*, 36*b* which are adapted to receive one end of spring 34 to adjust the tension on the spring. Accordingly, a strong player and hitter would increase the tension on spring 34 and indicator arm 30 and place the end of spring 34 in hole 36***a*, whereas beginners could decrease the tension on indicator arm 30 and spring 34 and place the end thereof in hole 36*b*.

The other end 30*b* of indicator arm 30 is preferably provided with a roller element 38 which rolls on base 20 when indicator arm 30 moves between its solid and dotted-line positions. In addition, this end of indicator arm 30 is provided with an indicating means, such as a suitable arrow 40, for indicating the position of the indicator arm after the tethered ball has been hit. As will be understood, cutout portion 28 of cover 22 is arranged such that indicator arrow 40 extends through cutout portion 28 to indicate the position of indicator arm 30. In a manner to be explained, when tethered ball 18 is hit, indicator arm 30 is moved about pivot 32 to indicate the relative force with which the ball is hit. This force is converted and calibrated into distance indications which are provided on the outer surface of cover 22, as shown at 42 in FIG. 1. In addition, cover 22 may be provided with removable indicia cards 44 which can be changed when the tension on spring 34 is changed by the player. As will be understood, indicia 42 have been calibrated to indicate the distance that an actual ball would have been hit so that the practice device 10 simulates this distance and provides an indication of the equivalent distance on cover 22 by the indicating arrow 40 lining up with the distance indicia 42.

The apparatus for actuating indicator arm 30 will now be explained in detail. More particularly, housing 12 is provided with a plurality of guiding means, which may be in the form of pulleys or the like. Indicator arm 30 is provided with a pulley 50 mounted thereon, and base 20 is provided with similar type guides or pulleys 52, 54, and 56 which all cooperate to guide the movement of line or cord 60 relative to indicator arm 30, cord storage device 14, and tethered ball 18. One end of cord 60 is attached to tethered ball 18 and extends about pulleys 56, 50, 52, and 54, with the other end of cord 60 being connected to cord storage device 14. More particularly, cord 60 includes a line portion 62 extending from cord storage device 14 to indicator arm 30, with line portion 62 extending about guide pulleys 50, 52, and 54. In addition, cord 60 includes a line portion 64 extending from guide pulley 50 on indicator arm 30, through pulleys 56, to the slide 66. As will be noted, tethered ball 18 and line portion 64 are connected via slide element 66 to line guide 16. Preferably, line guide 16 is provided with a large knot 16*a* to prevent slide 66 from sliding toward housing 12 and choking off a high hit ball. In this manner, when the tethered ball 18 is struck, slide element 66 slides along line guide 16 to guide the movement of tethered ball 18 and, at the same time, pulls on line 60 to pull it around pulleys 50, 52, and 54 and through pulleys 56 to actuate and move indicator arm 30 to the representative dotted-line position to indicate the equivalent distance that tethered ball 18 is hit. As will be understood, cord 60 is pulled out of housing 12 by ball 18, and since the cord 60 is elastic, it is stretched to allow line 64 to be fed out of housing 12.

In accordance with the present invention, housing 12 is also provided with a left-right indicator 70 for indicating the left-right angle at which tethered ball 18 is hit. Angle indicator 70 includes an arm 72 pivotally mounted at 74 to base 20. Indicating arm 72 is also provided with springs 76 for returning indicating arm 72 to its central position. The forward end 72*a* of indicating arm 72 is provided with cord 78 to which line guide 16 is fixedly attached. In this manner, when tethered ball 18 is hit, if it is hit at an angle, that is to the left or right of angle indicating arm 72, tethered ball 18 and slide element 66 will cause line guide 16 to urge indicating arm 72 to pivot to the left or right relative to base 20. An arrow indicator 75 is provided to indicate if arm 72 has moved to the left or right of a marking 77, which arrow is visible through cutout 29. Accordingly, if indicating arm 72 is moved to the left or right of its central position, the user will realize that cchanges have to be made to his stroke in order to straighten out his shot and avoid the left or right movement of the ball. As will be explained, arm 72 is returned to its central position by springs 76.

Housing 12 is also provided with means for holding distance indicator arm 30 and angle indicating arm 72 in their indicating positions after tethered ball 18 is hit. The holding means may take the form of a one-way clutch 80, pivotally mounted on the walls of base 20, such that the clutch member 80 moves into and out of engagement with line 64 and arm 72. Accordingly, as line 64 is pulled out of housing 12 through an opening 12*a* when tethered ball 18 is struck, line portion 64 operates to engage and actuate one-way clutch member 80 to pivot upwardly a distance proportional to the height of the shot. However, as soon as line 64 completes its forward direction of movement and begins to return toward housing 12, line portion 64, which is engaging one-way clutch 80, causes clutch 80 to pivot in the opposite direction and to clamp line portion 64 between one-way clutch member 80 and angle indicating arm 72. In addition, the engagement force of one-way clutch 80 is transmitted through line portion 64 to angle indicating arm 72 to hold angle indicating arm 72 in its left or right position after tethered ball 18 has been struck. In this manner, as one-way clutch 80 prevents line portion 64 from returning into housing 12, it operates to hold indicator arm 30 in its indicating position so that arrow 40 lines up with the indicia 42 on cover 22 to indicate the equivalent distance that tethered ball 18 is hit. In addition, as one-way clutch 80 operates to prevent indicating arm 72 from returning to its central position, as urged by springs 76, the player may then determine whether the angle indicating arm 72 has been moved to the left or right about pivot 74 by the tethered ball 18 by reading arrow indicator 75.

Figure 3:
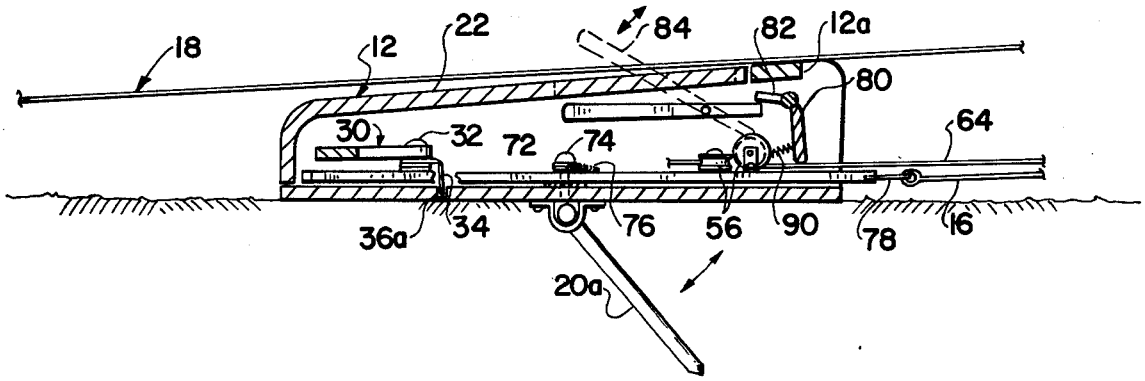
FIG. 3 is a sectional view, taken on line 3—3 of FIG. 2, to illustrate additional details with respect to the housing of the golf practice device.

As will also be explained herein, one-way clutch member 80 operates to provide an indication of the height with which tethered ball 18 is struck. More particularly, one-way clutch 80 is provided with an extension element 82 at one end thereof. Accordingly, as may be seen in FIG. 3, as one-way clutch 80 pivots in a counterclockwise direction, extension element 82 pivots downwardly and engages height indicator 84 which is pivotally mounted at 86 on base frame 20. When ball 18 is hit, line 64 is inclined an amount proportional to the height of the shot, and line 64 actuates clutch 80 to pivot upwardly a proportional amount. In this manner, one-way clutch 80 and element 82 cause height indicator 84 to pivot upwardly to its dotted-line position, an amount proportional to the height of the shot. In addition, cutout portion 26 in cover 22 is lined up with height indicator 84, such that it will move within cutout portion 26 to provide a visual indication to the player of the relative height with which the tethered ball 18 is hit.

Accordingly, as has been explained, one-way clutch 80 will maintain distance indicating arm 30 and angle indicating arm 72 in their indicating positions after the tethered ball 18 is struck and height indicating arm 84 is maintained in its indicating position by the frictional contact at pivot 86. In addition, the present invention also provides an indication as to whether the ball has been sliced or hooked. That is, on a slice shot, the tethered ball 18 will wind up to the right, and on a hook shot, the tethered ball 18 will wind up to the left. Therefore, when the ball is picked up, the direction in which it unwinds provides an indication as to whether the ball has been sliced or hooked. Once the player has studied these indications and has decided what changes to make in his stroke to improve his performance, the practice device of the present invention may then be reset. This is easily accomplished by merely actuating handle 88 connected to one end of one-way clutch 80. Actuation of this handle 88 causes one-way clutch 80 to pivot in a counterclockwise direction and thereby releases the force it applies to line portion 64 and angle indicating arm 72. As a result, spring 34 will urge distance indicating arm 30 back to its normal position, and springs 76 will operate to return angle indicating arm 72 to its central or normal position. A spring 90, connected to clutch 80, will move it back to its normal position after handle 88 is disengaged. To reset height indicator 84, the player merely pivots it downwardly so that it is brought back into engagement with extension element 82. The player then lines up tethered ball 18, in the manner shown in FIG. 1, and is ready to hit the next practice shot. Preferably, line 18 for the tethered ball is about 6 feet long and is positioned substantially in line with guide 16 and line 62.

Figure 4:
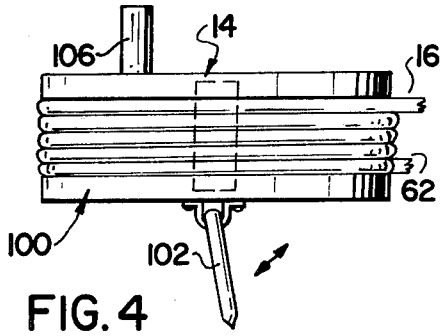
FIG. 4 is a side elevational view showing in detail the cord storage device of the present invention.
Figure 6:
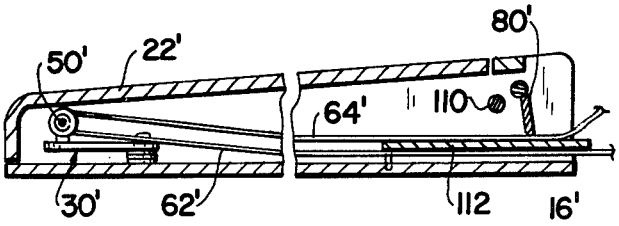
FIG. 6 is a sectional view of the embodiment shown in FIG. 5.

As shown in detail in FIG. 4, cord storage device 14 includes a reel 100 for winding up and storing lines 16 and 62. In addition, cord storage device 14 is provided with suitable means for attaching the device in a relatively fixed position spaced from housing 12. Such attaching means may include a spike arrangement 102, pivotally mounted on the bottom of cord storage device 14, for attaching it to the ground. During setup, reel 100 is unwound and may include about 15 feet of line each for guide 16 and line 62. Lines 16 and 62 are elastic and are stretched about an additional 2 feet, and then cord storage device 14 is spiked into the ground by means of spikes 102 at a distance of approximately 17 feet from where housing 12 is spiked into the ground by similar spikes 20*a*. Of course, this distance may be varied within a range of about 5 feet. When lay with the practice device 10 of the present invention has been finished, the reel 100 is wound up to contain lines 16 and 62 thereon. In the preferred embodiment, housing 12 is provided with suitable holes 104 for receiving spike 102 of the cord storage device 14, and a handle 106 is provided on reel 100 for purposes of convenience to wind up reel 100. In this manner, reel 100 may be mounted on housing 12 by inserting spike 102 through holes 104, and handle 106 may be employed to wind up lines 16 and 62 on reel 100. Reel 100 can then be stored in housing 12.

Figure 5:
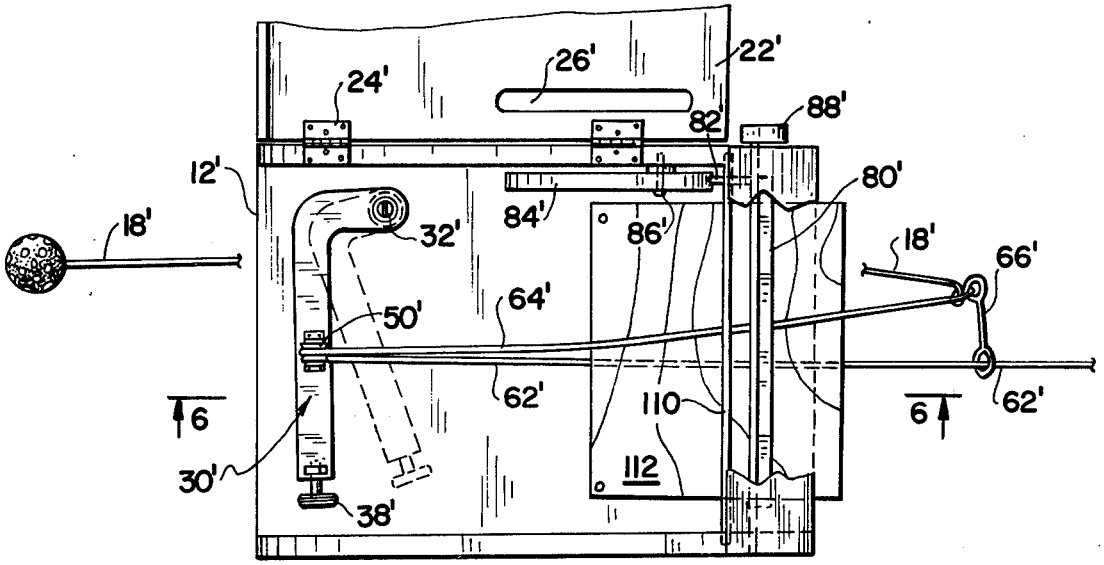
FIG. 5 is a top plan view illustrating an alternative embodiment of a golf practice device embodying the principles of the present invention.

Turning now to FIG. 5, there is shown an alternative embodiment of the present invention. In this embodiment, like parts are provided with rimed reference numerals corresponding to that of the first embodiment. In this embodiment, angle indicating arm 72 has been deleted, so that this embodiment only provides an indication of distance and height with which the tethered ball is hit. More particularly, in this embodiment, indicating arm 30' provides an indication of the equivalent distance with which the tethered ball is hit, while indicating arm 84' provides an indication of the height that the tethered ball 18' is hit. In this embodiment, a rod 110 is provided and is mounted just behind clutch 80' on housing 12', so that line 64', as it is being pulled out of housing 12' by tethered ball 18', engages rod 110 and prevents line 64' from being lifted upwardly at a point too far away from clutch 80'. That is, if rod 110 were not present, line 64' would begin to lift at a point much closer to arm 30' and would rovide an inaccurate height indication. Finally, it is also preferable to provide a member 112 in housing 12' to insure that lines 62' and 64' are maintained separate from each other during operation and also to perform the same function as knot 16*a* in the first embodiment.

In view of the foregoing, it will be appreciated that there has been provided an improved practice device for hitting a ball which provides complete and accurate information to the player for each shot which is hit, including indications as to distance, angle, and height. The player may then use this information to evaluate each shot and make whatever changes are necessary to improve his performance. It should also be noted that although the present invention has been described with respect to a golf practice device, it has broad application to any practice device for hitting a ball, of any type, including a baseball, a tennis ball, or the like.

A latitude of modification, change, and substitution is intended in the foregoing disclosure, and in some instances, some features of the invention will be employed without a correponding use of other features. Accordingly, it is appropriate that the appended claims be construed broadly and in a manner consistent with the spirit and scope of the invention herein.

What is claimed is:

1. A practice device for hitting a ball, comprising:

a housing and means for attaching said housing in a relatively fixed position, a line connector and means for attaching said connector in a relatively fixed position spaced from said housing, a guide extending between said housing and said line connector, a tethered ball mounted for movement on said guide, a line connected to said tethered ball, and a movable indicator arm mounted on said housing and actuated by said line when said tethered ball is hit for indicating the equivalent distance that the tethered ball is hit.

2. A practice device in accordance with claim 1 wherein said line connector is a line storage device including a reel for winding up and storing said line.

3. A practice device in accordancce with claim 1 wherein said indicator arm is pivotally connected to said housing and includes means for guiding said line to move relative to said indicator arm.

4. A practice device in accordance with claim 1 wherein said housing includes a one-way clutch for preventing said line from moving in one direction after said tethered ball is hit.

5. A practice device in accordance with claim 4 wherein said one-way clutch further includes means for indicating the height that said tethered ball is hit.

6. A practice device in accordance with claim 1 wherein said housing further includes means for indicating the angle that said tethered ball is hit.

7. A practice device in accordance with claim 6 wherein said angle indicating means includes a movable arm actuated by said guide to indicate the angle that said tethered ball is hit.

8. A practice device in accordance with claim 1 wherein said housing further includes means for indicating the angle that said tethered ball is hit, and further includes means for holding said indicator arm and said angle indicating means in their indicating positions after said tethered ball is hit.

9. A practice device in accordance with claim 8 wherein said holding means includes a one-way clutch mounted on said housing.

10. A practice device in accordance with claim 8 further including means mounted on said housing for releasing said holding means to release said indicator arm and said angle indicating means from their indicating positions.

11. A practice device in accordance with claim 1 wherein said indicator arm includes means for adjusting the tension thereon so that it may be reset for different strength hitters.

12. A practice device in accordance with claim 1 wherein said housing includes indicia for indicating the equivalent distance that said tethered ball is hit.

13. A practice device in accordance with claim 1 wherein said housing further includes a cover for opening said housing to store said line connecto therein and for cleaning said housing.

14. A practice device in accordance with claim 1 wherein said housing includes means for guide the movement of said line relative to said housing.

15. A practice device in accordance with claim 14 wherein said housing and said guiding means establish a triangular relationship for said line.

16. A practice device in accordance with claim 1 wherein said guide includes means for preventing said tethered ball from moving toward said housing to prevent choking of the tethered ball on high shots.

17. A practice device in accordance with claim 1 wherein said indicator arm is pivotally mounted on said housing such that said line moves substantially along a central axis of said housing when said indicator arm moves.

18. A golf practice device for hitting a golf ball, comprising:

a housing and means for attaching said housing in a relatively fixed position, a line connector and means for attaching said line connector in a relatively fixed position spaced from said housing, a guide extending between said housing and said connector, a tethered ball mounted for sliding movement on said guide, a line having a first portion extending from said line connector to an indicator arm and a second line portion extending from said indicator arm and connected to said tethered ball, and said mocable indicator arm mounted on said housing actuated by said line and said tethered ball when it is hit to move said indicator arm for indicating the equivalent that said tethered ball is hit.

* * * * *

UNITED STATES PATENT AND TRADEMARK OFFICE

CERTIFICATE OF CORRECTION

PATENT NO. : 4,139,197

DATED : February 13, 1979

INVENTOR(S) : OWEN D. WINDALL

It is certified that error appears in the above-identified patent and that said Letters Patent are hereby corrected as shown below:

Column 5, line 63, "rimed" should read --primed--

Column 6, line 11, "rovide" should read --provide--

Claim 18, line 16, "mocable" should read --movable--

Claim 18, last line, after "equivalent", insert --distance--

Signed and Sealed this

*Fifth* Day of *June 1979*

[SEAL]

*Attest:*

RUTH C. MASON
*Attesting Officer*

DONALD W. BANNER
*Commissioner of Patents and Trademarks*